United States Patent [19]

Cherry et al.

[11] 4,345,126

[45] Aug. 17, 1982

[54] VACUUM INTERRUPTER WITH TRANSFER-TYPE AXIAL MAGNETIC FIELD CONTACTS

[75] Inventors: Sidney J. Cherry, Elmira; Paul O. Wayland, Montour Falls, both of N.Y.

[73] Assignee: Westinghouse Electric Corp., Pittsburgh, Pa.

[21] Appl. No.: 136,196

[22] Filed: Apr. 1, 1980

[51] Int. Cl.[3] ..... H01H 33/66

[52] U.S. Cl. ..... 200/144 B; 200/147 R

[58] Field of Search ..... 200/144 B, 147 R

[56] References Cited

U.S. PATENT DOCUMENTS

| | | | |
|---|---|---|---|
| 3,211,866 | 10/1965 | Crouch et al. | 200/144 B |
| 3,244,843 | 4/1966 | Ross | 200/144 B |
| 4,081,640 | 3/1978 | Rich | 200/144 B |
| 4,117,288 | 9/1978 | Gorman et al. | 200/144 B |
| 4,260,864 | 4/1981 | Wayland et al. | 200/144 B |

*Primary Examiner*—Robert S. Macon

*Attorney, Agent, or Firm*—W. G. Sutcliff

[57] ABSTRACT

A vacuum interrupter contact structure in which central butt-type contacts serve as the load current carrying contacts with low resistive losses. Annular transfer arcing contacts are disposed coaxial about the butt-type contacts, with the arc which forms during interruption moving out to these arcing contacts. Axial magnetic field generating means are associated with the transfer arcing contacts to maintain a diffuse arc during interruption.

7 Claims, 3 Drawing Figures

VACUUM INTERRUPTER WITH TRANSFER-TYPE AXIAL MAGNETIC FIELD CONTACTS

BACKGROUND OF THE INVENTION

The present invention relates to vacuum-type circuit interrupters which are used in electrical distribution networks. The vacuum interrupter is an evacuated device in which electrical contacts are closed when the device is carrying fault or load current in a normally operating distribution network. The interrupter acts as a switch when the contacts are moved apart, with an arc forming during the initial seconds of contact opening. This arc will extinguish for an AC system at a natural current zero of the alternating current wave form. The arcing that takes place during opening of the vacuum interrupter is a high power arc, which must be dissipated effectively within the device without damaging the device. A variety of contact structures has evolved to prevent localized burning of the arc upon the contact structures, and to thereby ensure reliable, repetitive operation of the vacuum interrupter. A commonly used contact structure has spiral arms to provide current paths which produce a magnetic field which interacts with the arc current to drive the arc in a rotating fashion about the contact surface.

In order to prevent localized destructive arc burning upon the contact surfaces during interruption, the use of arc transfer-type contacts is disclosed in U.S. Pat. No. 3,244,843, and U.S. Pat. No. 4,081,640. The initial arc is struck between the normal load current-carrying conductors or contacts of the interrupter, with this initial arc which forms being transferred to an auxiliary electrode or set of electrodes.

It is well known that a magnetic field directed transverse to the arcing current will tend to produce arc movement and preferably rotary arc movement about the electrode structures. It is also known that an axial magnetic field directed parallel to the arc will tend to produce a diffuse arc condition which prevents overheating of the contacts which might otherwise lead to re-ignition of the arc following initial interruption. Such axial field vacuum interrupters are taught in U.S. Pat. No. 4,117,288 and in copending application Ser. No. 965,012, filed Nov. 30, 1978 and entitled "Vacuum Type Circuit Interrupter". The aforementioned U.S. Pat. No. 3,244,843 describes a device in which a pair of central butt contacts are employed as the load current-carrying contacts, with annular auxiliary arcing contacts about the butt contacts. The annular auxiliary contacts have multiple turn coils connected from the back surface of the auxiliary annular arcing contacts to the conductive support rod for the butt-type contacts. After transfer of the arc, these coil turns generate an axial magnetic field. The annular contacts are said to be operative to carry load current as well as the butt contacts and when both are fully closed, parallel load current-carrying paths are set up. The effect of this structure is to have current flowing through the coil conductor associated with the annular auxiliary contact, with the inherent resistive losses that this entails during normal load current-carrying operation.

The interrupter structure taught in aforementioned U.S. Pat. No. 4,117,288 utilizes annular cup-shaped electrodes, which serve as the normal load current-carrying conductors with a recessed arcing electrode pair within the cup-shaped main electrodes. The arc, upon separation of the cup-shaped contacts, transfers to the central disc-like contacts within the cup-shaped contact, and axial magnetic field generating coil turns are associated with the disc-like arcing contacts. In this structure, load current does not flow through the axial magnetic field generating coil turns until the interrupter is opened, and the arcing current flows between these recessed disc-like contacts. In the above-mentioned copending application, the contacts are essentially disc- or butt-type contacts with axial magnetic field generating coil turns extending from the back perimeter surfaces of the disc- or butt-type contacts, and connected and supported from the conductive support rod for the butt- or disc-like contacts. In such an embodiment, the load current will normally flow through the axial field generating coil portions. It has been found that for high power interruption it is difficult to generate sufficient axial magnetic field without introducing undesirable resistive load from the coil turn portions into the interrupter structure. Such additional load resistance may cause excessive heating of the conductive support stems for the contacts.

SUMMARY OF THE INVENTION

A vacuum interrupter structure is detailed which employs a pair of central butt-type load current-carrying contact members and a pair of annular transfer arcing electrodes about the butt-type contacts. Axial magnetic field generating coil turn portions extend from the back perimeter surfaces of the annular transfer arcing electrodes through conductive support means in parallel with the load current-carrying butt-type conductor and support rod. The auxiliary transfer arcing electrodes do not form a part of the normal load current-carrying path or circuit of the interrupter, but are only brought into play during separation of the butt-type contacts. The arc which initially forms between the butt contacts is transferred to the annular auxiliary transfer arcing electrodes due to the natural bowing outward of the arc. The arc current then flows through the axial field generating coil turn portion setting up the axial magnetic field parallel to the arc path, and maintaining a diffuse arc condition which prevents arc burning on localized portions of the annular auxiliary transfer contact portions.

DESCRIPTION OF THE PREFERRED EMBODIMENT

Figure 1:
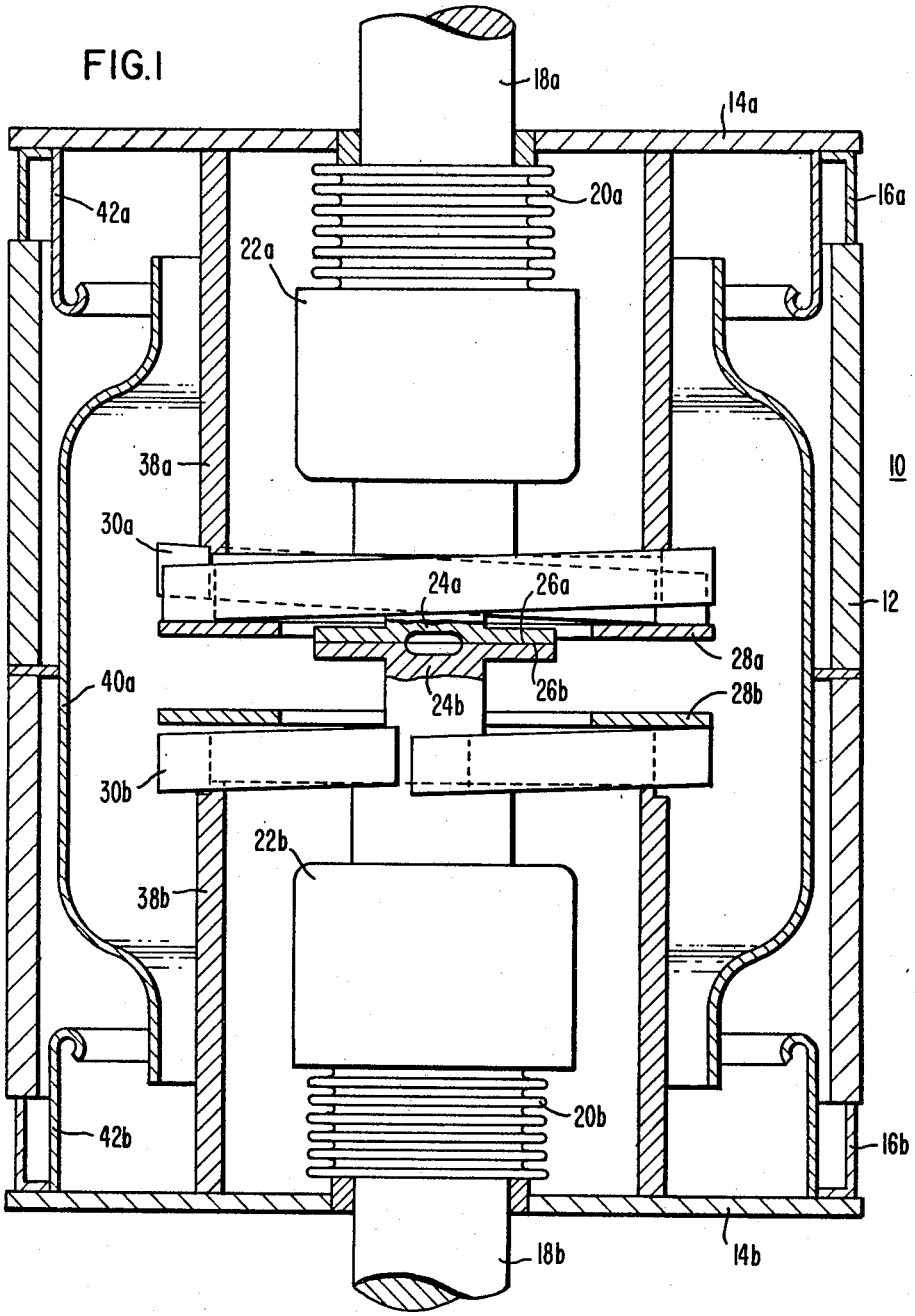
FIG. 1 is a cross-sectional view of the vacuum interrupter device of the present invention.

The vacuum interrupter 10 seen in FIG. 1 comprises a generally cylindrical insulating envelope portion 12 sealed at each end to conductive end plates 14*a*, 14*b* via annular seal members 16*a*, 16*b*. A pair of conductive support rods 18*a*, 18*b* are sealed through respective end plates 14*a*, 14*b* via bellow seal means 20*a* and 20*b* which permit axial movement of each of the support rods. Such axial movement is provided by external operating means, not shown, for applying axial force on the support rods. A cup-shaped bellows shield 22a, 22b is disposed from the respective support rods about the bellow seal means 20a, and 20b to protect same from hot arc-evolved material and prevent rupture of the bellow seal. A pair of butt-type contacts 24a and 24b are disposed at extending ends of the support rods 18a and 18b respectively. The butt-type contacts 24a and 24b have a raised annular surface 26a and 26b, which is seen in the closed contact mating position in FIG. 1. The annular contact surfaces 26a, 26b minimize contact welding of these load current carrying contacts, and are disposed proximate the perimeter of the butt contacts to facilitate outward bowing and transfer of the arc during interruption.

An annular transfer arcing contact 28a, 28b is disposed coaxially about respective butt type contact 24a, 24b. Axial magnetic field generating means 31a, 30b extend from the rear perimeter surface of the annular transfer arcing contacts 28a, 28b.

Figure 2:
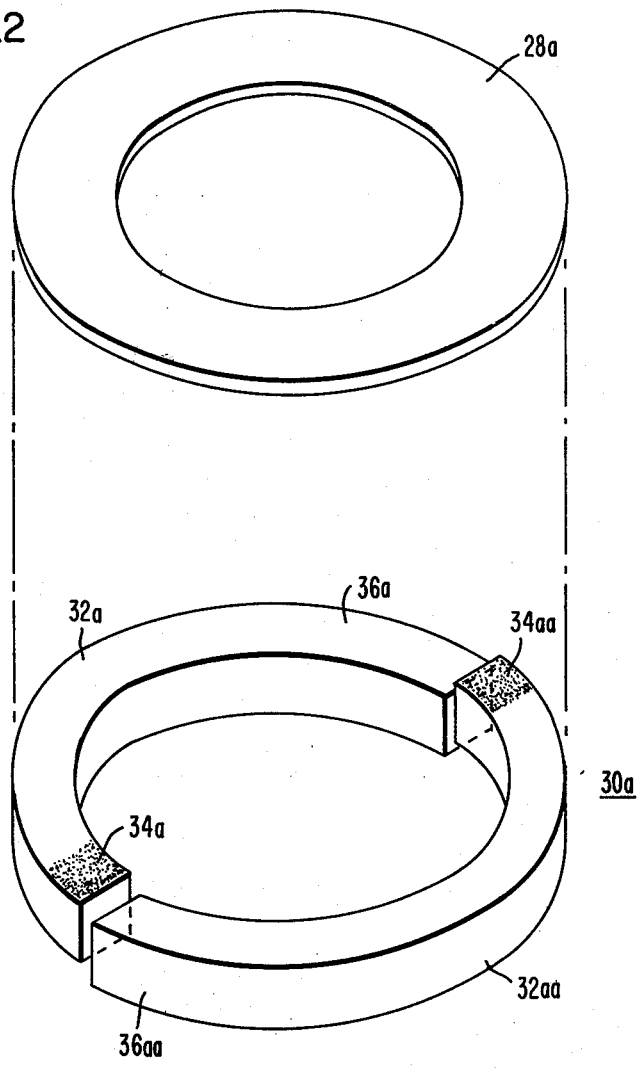
FIG. 2 is a perspective view of a portion of the vacuum interrupter as seen in FIG. 1 showing in greater detail the relationship of the annular transfer arcing electrode and the axial magnetic field coil turn portions associated with such electrode.

The respective axial magnetic field generating means 30a and 30b, as best seen in FIG. 2, each comprise a pair of half-turn, semi-circular coil portions, respectively 32a and 32aa, and 32b and 32bb. One end 34a, 34aa, 34b, 34bb of each half-turn coil portion is electrically connected to the back of the respective annular transfer arcing contact 28a or 28b. The other ends 36a, 36aa, 36b, 36bb of the half-turn coil portions are electrically connected to and supported by conductive support cylinder 38a and 38b. The support cylinder 38a and 38b extend from and are supported by end plate members 14a and 14b. The support cylinders 38a and 38b thus maintain the annular transfer arcing contacts in fixed, spaced-apart relationship to each other. During interruption, when the butt contacts are moved apart to the open circuit position, the arc which initially forms between the butt contacts is transferred to the annular transfer arcing contacts as a result of the natural tendency of the arc to bow or move outward from the central axis of the interrupter. When the arc has been transferred to the annular transfer arcing contacts, the current path is through the respective axial magnetic field generating means and the conductive support cylinders to generate the desired axial magnetic field parallel to the arc path between the contacts.

The coil turn portions of the axial magnetic field means 30a and 30b are wound in a circumferentially additive manner so that an axial magnetic field is generated in the gap between the annular contact surfaces. This axial magnetic field is parallel to the arc path and maintains a diffuse arc condition which prevents localized heating of the contact surfaces. In this way, very high current interruption capability is provided with high reliability and low contact surface erosion.

Conventional arcing shields 40a and 42a and 42b are provided respectively about the central portion of the device in which the arcing occurs, and also proximate the end seal members 16a and 16b.

The physical relationship of the annular transfer arc contact portions 28a and the coil turn portions 30a and support cylinder 32a is seen in greater detail in perspective in FIG. 2. In this view, the various portions are separated in exploded fashion prior to assembly, and the coil turns 30a are seen as being a pair of half-turn coil portions, which are non-planar so that one extending terminating end such as 34a of each respective half-turn portion is connected to the transfer arc contact. The other end 36a is electrically connected to and supported upon the end portion of the cylindrical support cylinder 38a.

In FIG. 1 the butt-type contacts 24a and 24b are seen in closed, mating current-carrying position with butt-type contact 24a being in generally planar flush relationship to the annular transfer arc contact 28a about it. The other butt-type contact 24b projects axially beyond the annular transfer arc contact 28b into mating relationship with butt-type contact 24a. Interruption is achieved by axially moving the butt-type contact 24b away from butt-type contact 24a, preferably so that contact 24b is also then flush and planar with annular contact 28b. It is possible to move both of the butt-type contacts 24a and 24b so that they both may project beyond the annular transfer arc contact portions 28a and 28b, with the butt-type contacts 24a and 24b brought into mating closed contact position midway between the spaced-apart annular transfer arc contacts. Interruption is then achieved by axially moving each of the butt-type contacts 24a and 24b away from each other either flush with the annular transfer arc contacts or even recessed beyond the annular transfer arc contact surface.

In the embodiment of the invention seen in FIG. 3, only the electrode and support portion of the interrupter are shown, and the contact electrode structures and axial magnetic field means are the same for each contact and will be described for only one contact. In the embodiment shown, only one of the contact assemblies is movable via a conventional bellows between the support rod and the interrupter end plate. Both of the contact assemblies can be made movable with such a bellows real arrangement. The support rod 44 terminates with a butt-type contact member 46 which in the closed current carrying interrupter position is in electrical contact with the like member of the other contact.

An annular transfer arcing contact 48 is disposed about the butt-type contact member 46, with the arcing surface 50 of transfer arcing contact 48 being set back from the plane of the butt-type contact by a small dimension to insure that the respective transfer arcing contacts are spaced from the opposed contacts even when the butt-type contacts are in the closed electrical contacting position. A pair of half-turn coil members 52 and 54 are connected at one end to the back of the transfer arcing contact, with the other ends of the half-turn coil members connected to a support disc 56 which is mounted on the support rod 44. The half-turn coil members 52 and 54 are spaced apart and provide a circumferential current path during interruption when the arc current has transferred to the transfer arc contacts. An axial magnetic field parallel to the arc current is thus generated, and the arc current is kept diffused to prevent localized overheating.

Figure 3:
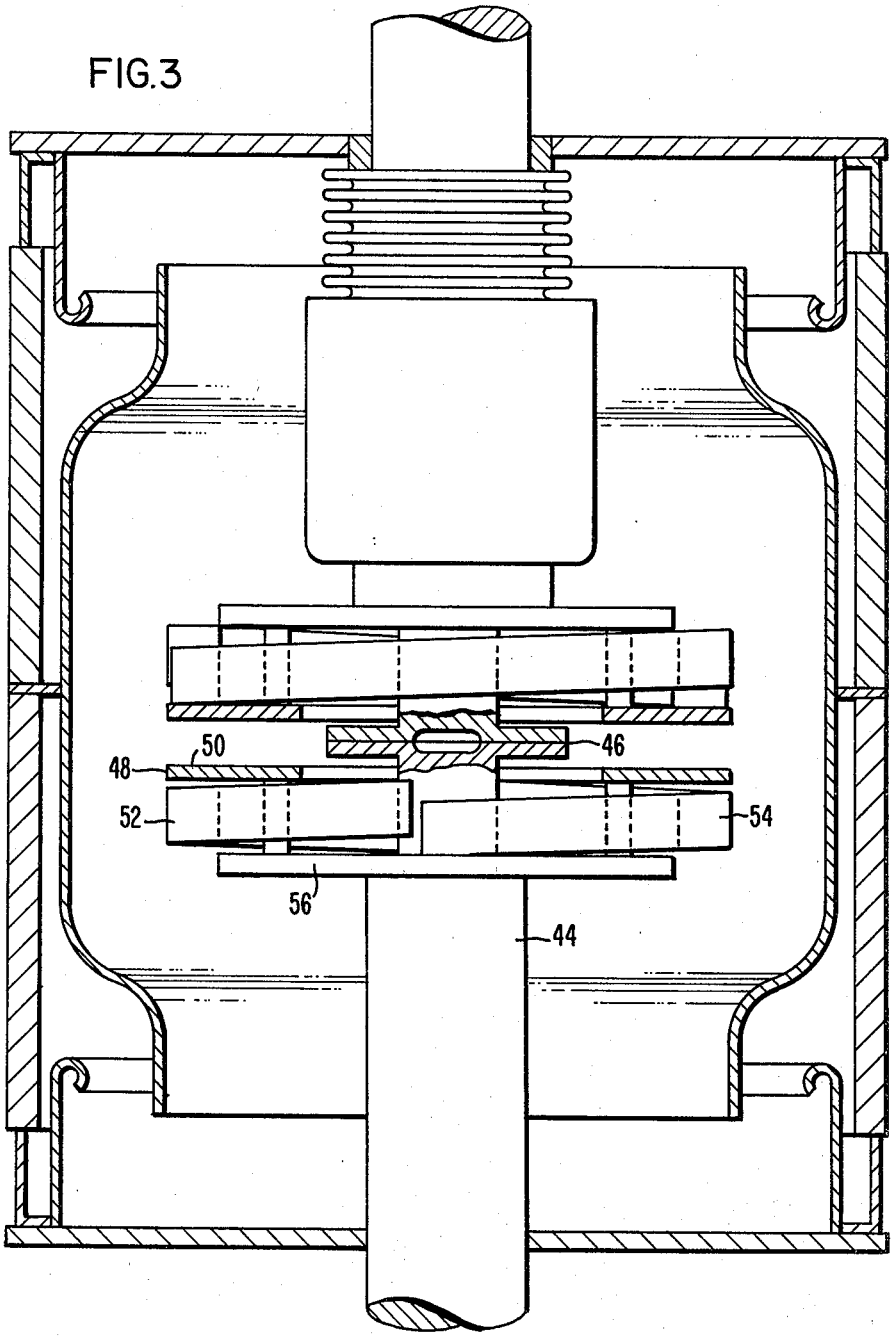
FIG. 3 is another embodiment of the present invention seen in cross section with the butt-type central contacts projecting beyond the annular transfer arcing electrode portions.

In the embodiment of FIG. 3, the transfer arcing contacts are supported from the support rod and are movable with the support rod and the associated butt-type contact.

The butt contacts project beyond the plane of the transfer arcing contacts, so that the butt contacts continue to carry the full load current during normal closed contact operation of the interrupter. The transfer arcing contacts again only come into play when the butt contacts are moved apart, which also moves the transfer arcing contacts farther apart due to their being supported from the support rod.

We claim:

1. In a vacuum circuit interrupter in which a pair of primary current-carrying electrical contacts are relatively movable into closed position within a hermetically sealed, evacuated, generally cylindrical envelope, and wherein the primary current-carrying electrical contacts in the closed position carry the electrical line current to which the interrupter is connected, and which primary current-carrying electrical contacts are disposed at the extending ends of conductive support rods which are aligned along the cylindrical axis of the envelope and are sealed therethrough to external electrical connection means, the improvement wherein annular transfer arcing contacts are disposed about each of the primary current-carrying contacts, which annular transfer arcing contacts comprise an annular arcing portion and an axial magnetic field generating portion extending from the back side of the annular arcing portion to a supporting conductive member, whereby when the primary current-carrying contacts are opened the arc which forms between these primary contacts as they are moved apart, transfers to the annular arcing portions of the annular transfer contact, and the arc current flowing through the magnetic field generating means produces an axial magnetic field parallel to the arc path between contacts to maintain the arc diffuse.

2. The vacuum circuit interrupter set forth in claim 1, wherein one of the primary current-carrying electrical contacts is disposed with the current-carrying contact surface in the same plane as the annular arcing portion arcing surface.

3. The vacuum circuit interrupter set forth in claim 1, wherein the relatively movable electrical contacts project toward each other beyond the annular arcing portion arcing surface, and the axial magnetic field generating coil turn portion is connected to and supported from the conductive support rods.

4. The vacuum circuit interrupter set forth in claim 1, wherein the axial magnetic field generating means comprises a pair of half-turn coil portion for each contact, with the half-turns being wound in a circumferentially additive manner to optimize the axial magnetic field.

5. In a vacuum circuit interrupter in which a pair of primary current-carrying electrical contacts are relatively movable into closed position within a hermetically sealed, evacuated, generally cylindrical envelope, and wherein the primary current-carrying electrical contacts in the closed position carry the electrical line current to which the interrupter is connected, and which primary current-carrying electrical contacts are disposed at the extending ends of conductive support rods which are aligned along the cylindrical axis of the envelope and are sealed therethrough to external electrical connection means, the improvement wherein annular transfer arcing contacts are disposed about each of the primary current-carrying contacts, which annular transfer arcing contacts comprise an annular arcing portion and an axial magnetic field generating portion extending from the back side of the annular arcing portion to a supporting conductive member, with axial magnetic field generating portions wound in a circumferentially additive manner to optimize the axial magnetic field, whereby when the primary current-carrying contacts are opened the arc which forms between these primary contacts as they are moved apart, transfers to the annular arcing portions of the annular transfer contact, and the arc current flowing through the magnetic field generating means produces an axial magnetic field parallel to the arc path between contacts to maintain the arc diffuse.

6. The vacuum circuit interrupter set forth in claim 5, wherein the half-turn coil portions extend from the back surface of the transfer arcing contacts to a conductive cylindrical support member which is supported from the envelope end portions.

7. The vacuum circuit interrupter set forth in claim 5, wherein the half-turn coil portions extend from the back surface of the transfer arcing contacts and are supported from the conductive support rods for the butt-type contacts.

* * * * *